US009071909B2

(12) United States Patent
Li et al.

(10) Patent No.: US 9,071,909 B2
(45) Date of Patent: Jun. 30, 2015

(54) ELECTROMAGNETIC TRANSDUCER

(75) Inventors: Lin-Zhen Li, Shenzhen (CN); Suo-He Wei, Shenzhen (CN)

(73) Assignees: AAC ACOUSTIC TECHNOLOGIES (SHENZHEN) CO., LTD., Shenzhen (CN); AMERICAN AUDIO COMPONENTS INC., La Verne, CA (US)

( * ) Notice: Subject to any disclaimer, the term of this patent is extended or adjusted under 35 U.S.C. 154(b) by 841 days.

(21) Appl. No.: 13/325,693

(22) Filed: Dec. 14, 2011

(65) Prior Publication Data

US 2012/0177247 A1 Jul. 12, 2012

(30) Foreign Application Priority Data

Jan. 7, 2011 (CN) ..... 2011 2 0004252

(51) Int. Cl.

| | |
|---|---|
| ***H04R 1/00*** | (2006.01) |
| ***H04R 11/02*** | (2006.01) |
| ***H04R 9/02*** | (2006.01) |
| *H04R 9/06* | (2006.01) |
| *H04R 1/02* | (2006.01) |

(52) U.S. Cl.

CPC ..... *H04R 11/02* (2013.01); *H04R 9/025* (2013.01); *H04R 9/06* (2013.01); *H04R 1/025* (2013.01)

(58) Field of Classification Search

USPC ..... 381/412, 396, 392, 395

See application file for complete search history.

(56) References Cited

U.S. PATENT DOCUMENTS

| | | | | |
|---|---|---|---|---|
| 8,098,877 | B2 * | 1/2012 | Meyer | 381/396 |
| 8,593,018 | B2 * | 11/2013 | Furuich et al. | 310/29 |
| 2002/0039431 | A1 * | 4/2002 | Chang | 381/412 |

* cited by examiner

*Primary Examiner* — Davetta W Goins
*Assistant Examiner* — Amir Etesam
(74) *Attorney, Agent, or Firm* — Anova Law Group, PLLC

(57) ABSTRACT

A multifunctional electromagnetic transducer includes a bracket, a vibrating unit including a magnetic circuit part receiving in the bracket, and a plurality of helical wound springs assembled to the bracket for sustaining the magnetic circuit part. The magnetic circuit part defines a pole plate, a first magnet disposed at a center portion of the pole plate, and a plurality of second magnets surrounding the first magnet and forming a magnetic gap corporately with the first magnet. Each of the second magnets forms a receiving gap corporately with an adjacent second magnet. A voice coil is partially inserted into the magnetic gap.

11 Claims, 2 Drawing Sheets

ELECTROMAGNETIC TRANSDUCER

FIELD OF THE INVENTION

The present disclosure relates to transducers to be mounted in terminal equipments for converting electrical signals to audible sounds, and more particularly to an electromagnetic transducer.

DESCRIPTION OF RELATED ART

With the rapid development of the portable devices such as cellular phones, people request for more and more functions. In the field of music enjoying of the cellular phone, a multi-function device enabling providing both audible and tactile sensations for amusement has already been widely used, which boosts the quick development of multifunctional devices.

An electromagnetic transducer related to the present invention comprises a bracket, a magnetic circuit part received in the bracket, and an assistant part connecting to the bracket. The magnetic circuit part includes a single magnet and a single magnetic frame corporately forming a magnetic circuit. The magnetic frame is assembled with the assistant part so that the magnetic circuit part is suspended in the bracket by the assistant part. Elastic plate are generally used as a part of the assistant part, and the magnetic circuit part could vibrate in the corresponding range of frequencies actuating by the elastic deformation of the elastic plate. However, the above mentioned elastic plate typically enable generating deformation only along one direction, which limits the vibrating amplitude of the vibrating unit, and leads to damage of inner components of the vibrator during falling off.

Therefore, it is necessary to provide a new multifunctional electromagnetic transducer for solving the problems mentioned above.

DETAILED DESCRIPTION OF THE EMBODIMENT

Reference will now be made to describe the exemplary embodiment of the present invention in detail.

Figure 1:
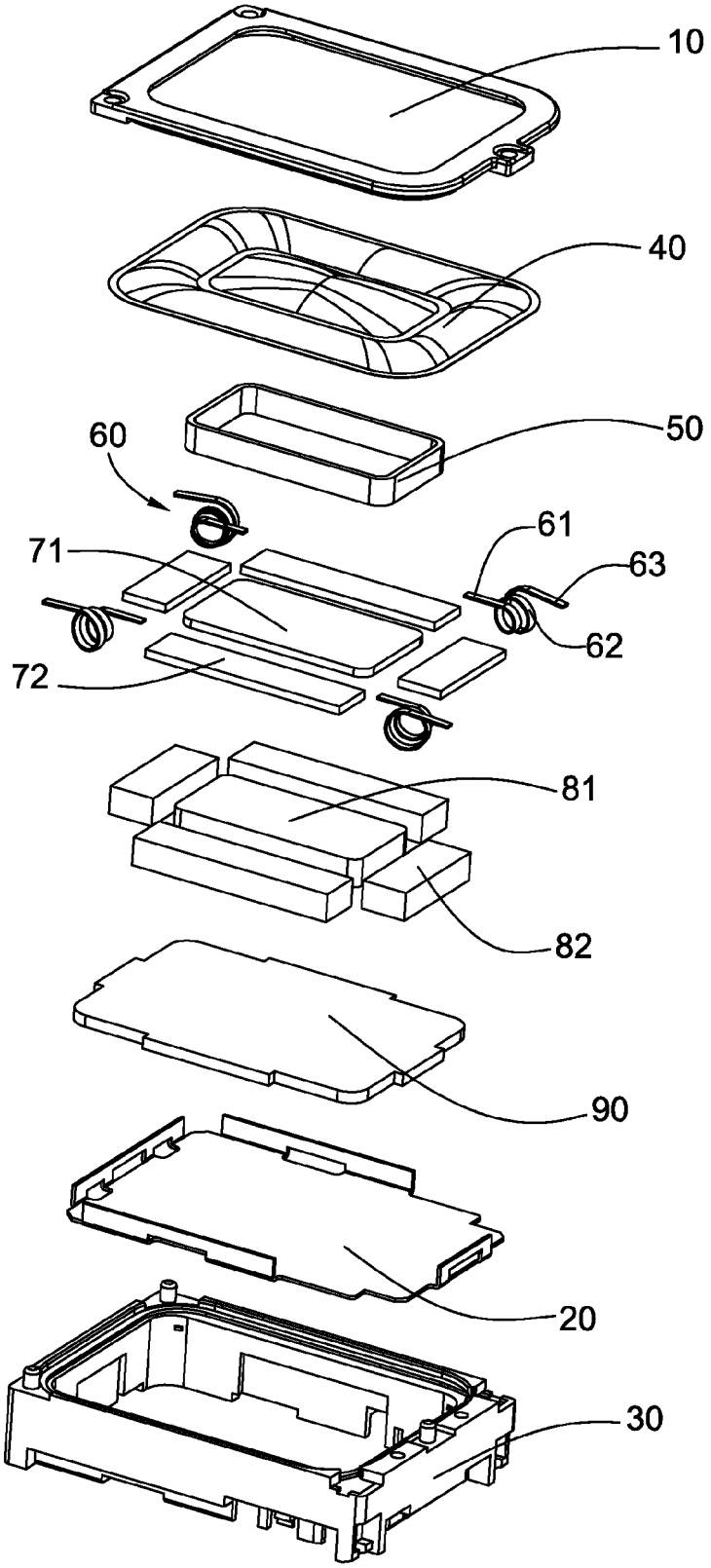
FIG. 1 is an isometric exploded view of a multifunctional electromagnetic transducer in accordance with an exemplary embodiment of the present disclosure.
Figure 2:
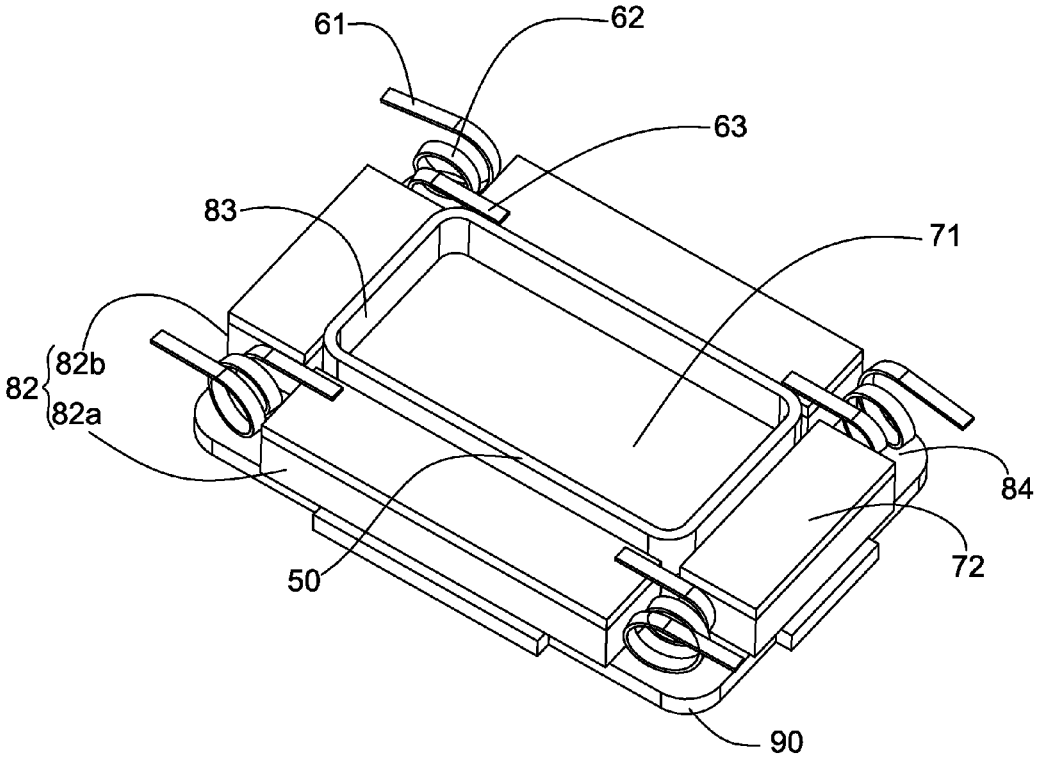
FIG. 2 is an isometric view of a magnetic circuit part of the multifunctional transducer shown in FIG. 1.

Referring to FIGS. 1 and 2, a multifunctional electromagnetic transducer comprises a bracket 30 forming an inner face, a lower cover 20 assembled with the bracket 30, a magnetic circuit part suspended in the bracket 30, an assistant part assembled to the bracket 30 for suspending the magnetic circuit part in the bracket 30, an voice generating part actuated by the magnetic circuit part, and an upper cover 10 protecting the voice generating part. The voice generating part comprises a diaphragm 40 supported by the bracket 30, and a voice coil 50 connected directly or indirectly with a lower surface of the diaphragm 40 and actuated by the magnetic field of the magnetic circuit part. The upper cover 10 is joined with the periphery of the diaphragm 40. The multifunctional electromagnetic transducer enables generating both sound and vibration.

Referring especially to FIG. 2, the magnetic circuit part includes a pole plate 90, a first magnet positioned at a central portion of the pole plate 90, a plurality of second magnets positioned at a periphery portion of the pole plate 90 and surrounding the first magnet. In the embodiment, four second magnets 82 are provided to surround the first magnet 81, and include a pair of longer magnets 82*a* respectively opposed to a longer end of the first magnet 81 and a pair of shorter magnets 82*b* respectively opposed to a shorter end of the first magnet 81. A magnetic gap 83 is formed between the first magnet 81 and the second magnets 82 for partially receiving the voice coil 50. The combination of the pole plate 90, the first magnet 81 and the second magnets 82 serves as a vibrating unit. Each of the first and second magnets 81,82 is provided with an upper plate 71, 72 attached to top surfaces thereof. The longer magnet 82*a* forms a receiving gap 84 corporately with an adjacent shorter magnet 82*b*. Each of the receiving gaps 84 receives one assistant part therein.

Figure 3:
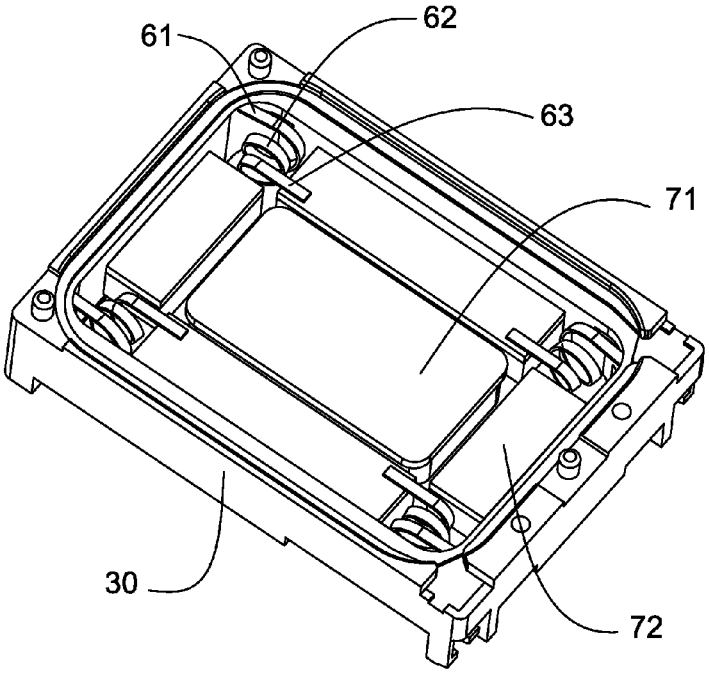
FIG. 3 is an isometric view of a combination of a bracket, an assistant part and the magnetic circuit part of the multifunctional electromagnetic transducer shown in FIG. 1.

Referring to FIG. 3, in the present exemplary embodiment, the assistant part includes a plurality of helical wound springs 60. In the embodiment, four helical wound springs 60 are provided. Each of the elastic helical wound spring 60 defines a retaining end 61 assembling to the bracket 30, a connecting end 63 attached to the vibrating unit, and a helical spring coil 62 extending from the retaining end 61 to the connecting end 63. The connecting end 63 is retained on the vibrating unit by soldering or adhesive. A center axis of the helical spring coil 62 is vertical to the vibrating direction of the vibrating unit.

The helical spring coil 62 defines a convolute main portion, the diameter of convolute main portion is gradually reduced from one end to the other end. In an alternative embodiment, the diameter of convolute main portion is gradually increased from the center portion to the peripheral end. The helical wound spring 60 can improves elasticity on a horizontal plane so as to protect the multifunctional electromagnetic transducer from being damaged during falling off. Therefore, each of the spring coils 62 is capable of generating deformation on the convolute main portion along two perpendicular directions. The deformation along the vibrating direction, which is perpendicular to the pole plate, causes the vibration of the vibrating unit. The deformation along the direction perpendicular to the vibrating direction can protect the vibrating unit from dashing other components during falling off.

The direction of the magnetic pole of the first magnet 81 is reverse to the direction of the magnetic pole of the second magnet 82. In the present exemplary embodiment, the lower face of the first magnet 81 is defined as South Pole, and the upper face of the first magnet 81 is defined as North Pole. At the same time, the lower face of each second magnet 82 is defined as North Pole, and the upper face of the second magnet 82 is defined as South Pole. Therefore, the first magnet 81 and the four second magnets 82 are forming a magnetic circuit with high magnetic flux density for actuating the voice coil 50 supplied with currents to drive the diaphragm 40 along the vibrating direction. And the high magnetic flux density could make the voice generating part more sensitive and increase the vibrating amplitude of the vibrating unit.

While the present invention has been described with reference to the specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A multifunctional electromagnetic transducer, comprising:

a bracket ;

a vibrating unit receiving in the bracket and including a magnetic circuit part with a magnetic gap, the magnetic circuit part including a pole plate, a first magnet fixed at a central portion of the pole plate, a plurality of second magnets disposed surrounding the first magnet;

a voice coil partially inserted into the magnetic gap;

an assistant part assembled to the bracket for suspending the magnetic circuit part in the bracket; wherein the assistant part includes a plurality of helical wound springs defining a retaining end assembled to an inner face of the bracket, a connecting end attached to the vibrating unit, and a helical spring coil extending from the retaining end to the connecting end, the helical wound spring being capable of deformations along a direction parallel to the vibrating direction of the vibrating unit, and along a direction perpendicular to the vibrating direction;

each of the second magnets forms a receiving gap corporately with an adjacent second magnet for receiving a corresponding helical wound spring.

2. The multifunctional electromagnetic transducer as described in claim 1, wherein the helical spring coil defines a convolute main portion, and the diameter of convolute main portion is gradually reduced from one end to the other end.

3. The multifunctional electromagnetic transducer as described in claim 1, wherein the helical spring coil defines a convolute main portion, the diameter of convolute main portion is gradually increased from the center portion to the peripheral end.

4. The multifunctional electromagnetic transducer as described in claim 1, wherein each of the first and second magnets is provided with an upper plate attached to top surfaces thereof.

5. A multifunctional electromagnetic transducer, comprising:

a bracket ;

a vibrating unit receiving in the bracket and including a magnetic circuit part with a magnetic gap, the magnetic circuit part including a pole plate, a first magnet disposed on the pole plate, a plurality of second magnets surrounding the first magnet;

an assistant part assembled to the bracket for suspending the magnetic circuit part in the bracket;

a diaphragm supported by the bracket;

a voice coil directly or indirectly attached to the diaphragm and partly inserted into the magnetic gap; wherein the assistant part includes a plurality of helical wound springs defining a retaining end assembled to an inner face of the bracket a connecting end attached to the vibrating unit, and a helical spring coil extending from the retaining end to the connecting end;

each of the second magnets is forming a receiving gap corporately with an adjacent second magnet, each of the receiving gaps receives one helical wound spring.

6. The multifunctional electromagnetic transducer as described in claim 5, wherein the helical spring coil defines a convolute main portion, the diameter of convolute main portion is gradually reduced from one end to the other end.

7. The multifunctional electromagnetic transducer as described in claim 5, wherein the helical spring coil defines a convolute main portion, the diameter of convolute main portion is gradually increased from the center portion to the peripheral end.

8. The multifunctional electromagnetic transducer as described in claim 5, wherein each of the first and second magnets is provided with an upper plate attached to top surfaces thereof.

9. A multifunctional electromagnetic transducer, comprising:

a bracket with an inner face;

a vibrating unit vibrating along a vibrating direction and having a magnetic circuit part with a receiving gap and a plurality of receiving gaps, the magnetic circuit part including a first magnet and a plurality of second magnets surrounding the first magnet;

a voice coil actuating the vibrating unit to vibrate along the vibrating direction; wherein each of receiving gaps formed by two adjacent second magnets for receiving a helical wound spring therein, each of the helical wound spring being capable of deformations along the vibrating direction and along a direction perpendicular to the vibrating direction.

10. The multifunctional electromagnetic transducer as described in claim 9, wherein the helical wound spring includes a first end fixed to the bracket, a second end fixed to the vibrating unit, and a helical spring coil extending from the first end to the second end.

11. The multifunctional electromagnetic transducer as described in claim 9, wherein the helical spring coil defines a diameter gradually increased or decreased from the first end toward the second end.

* * * * *